343-755 SP
7/8/86 OR 4,599,623

United States Patent [19]
Havkin et al.

[11] Patent Number: 4,599,623
[45] Date of Patent: Jul. 8, 1986

[54] POLARIZER REFLECTOR AND REFLECTING PLATE SCANNING ANTENNA INCLUDING SAME

[76] Inventors: Michael Havkin, 14 Hanassi Harishon, Rehovot; Eda Orleansky, 7 Hagidud Haivri, Rishon LeZion; Claude Samson, 3 Savion Street, Rehovot, all of Israel

[21] Appl. No.: 509,778

[22] Filed: Jun. 30, 1983

[30] Foreign Application Priority Data

Jul. 15, 1982 [IL] Israel ..... 66327

[51] Int. Cl.[4] ..... H01Q 19/95; H01Q 19/18

[52] U.S. Cl. ..... 343/756; 343/781 P; 343/909

[58] Field of Search ..... 343/756, 909, 781 R, 343/781 P, 781 CA, 909, 912

[56] References Cited

U.S. PATENT DOCUMENTS

| | | | |
|---|---|---|---|
| 2,736,895 | 2/1956 | Cochrane | 343/756 |
| 3,084,342 | 4/1963 | Fuller et al. | 343/756 |
| 3,161,879 | 12/1964 | Hannan et al. | 343/18 |
| 3,166,724 | 1/1965 | Allen | 333/24.1 |
| 3,281,850 | 10/1966 | Hannan | 343/756 |
| 3,340,535 | 9/1967 | Damonte et al. | 343/756 |
| 3,737,904 | 6/1973 | Mori et al. | 343/18 |
| 3,754,271 | 8/1973 | Epis | 343/156 |
| 3,771,160 | 11/1973 | Laverick | 343/756 |
| 3,854,140 | 12/1974 | Ranghelli et al. | 343/756 |
| 4,298,876 | 11/1981 | Crochet | 343/756 |
| 4,342,034 | 7/1982 | Monser | 343/756 |
| 4,479,128 | 10/1984 | Brunner | 343/756 |

OTHER PUBLICATIONS

Radio Antennas for Aircraft and Aerospace Vehicles, Ed. Blackband, Agard Conference Proceedings, vol. 15 (Nov. 1967), pp. 149–164.

IEEE Transactions on Antennas and Propagation, May 1973, pp. 376–378.

1983 International Symposium Digest, Antennas and Propagation, vol. 2, May 23–26, 1983, pp. 429–431.

*Primary Examiner*—Eli Lieberman
*Attorney, Agent, or Firm*—Browdy and Neimark

[57] ABSTRACT

A polarizer reflector includes a reflecting layer backing a meander-line polarizer effective to convert the incident beam from linear polarization to circular polarization during the propagation of the beam forwardly through the polarizer, and to reconvert the beam reflected from the reflecting layer from circular polarization to linear polarization but rotated at a predetermined angle, preferably at a right angle, with respect to the polarization of the incident beam. Also described is a reflecting plate-type scanning antenna including a front collimating paraboloid reflector with the above-described polarizer reflector serving as the back reflector, which arrangement has been found to substantially increase the frequency range of the scanning antenna.

9 Claims, 3 Drawing Figures

FIG. 1
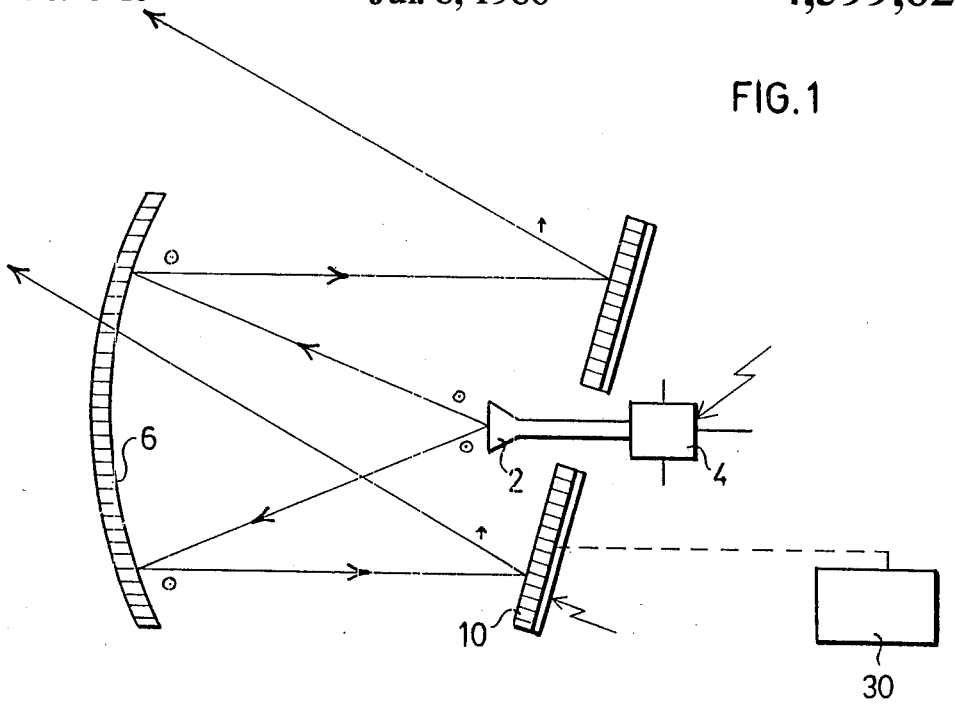
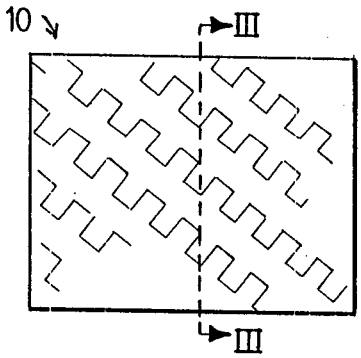
FIG 2
FIG. 3
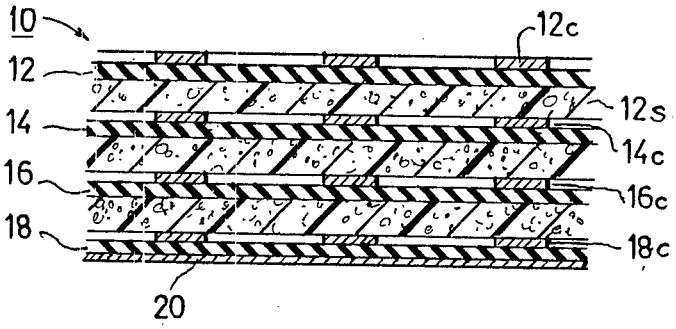

POLARIZER REFLECTOR AND REFLECTING PLATE SCANNING ANTENNA INCLUDING SAME

BACKGROUND OF THE INVENTION

The present invention relates to polarizer reflectors and to reflecting plate type scanning antennas including such polarizer reflectors. The invention is particularly applicable to the type of scanning antenna, sometimes called the Elliott Cassegrain Scanning Antenna, in which the movement of the antenna beams is controlled by movement of a flat reflecting plate, and is therefore described below with respect to such an antenna.

This type of scanning antenna has been known for about 30 years. Briefly, it includes a feeder for feeding plane polarized electromagnetic waves, a collimating paraboloid disposed in front of the feeder means for forming a collimated plane polarized beam, and a flat reflecting plate disposed behind the collimating paraboloid for producing a reflected beam polarized at right angles to the incident beam from the collimating paraboloid. Thus, the collimating paraboloid forms a collimated plane polarized beam as in a normal horn-and-dish type antenna; while the flat reflecting plate reflects the collimated beam according to the laws of geometrical optics (i.e., the angle of incidence is equal to the angle of reflection), but at the same time, it "twists" the plane of polarization through a right angle. Scanning is achieved by moving the reflecting plate. This provides one of the main advantages of such an antenna since it obviates the need for moving the collimating paraboloid or the feeder. Such an antenna is particularly advantageous where multibeam operation is required, e.g., in a monopulse system, as it obviates the need for rotary joints.

In a known construction of the reflecting plate type scanning antenna, the reflecting plate, sometimes called a "twist reflector," usually employs an array of parallel wires or strips whose front surface is approximately a quarter wave length from a conducting metal back plate. Such an antenna operates on the principle that the incident electric field, polarized at 45° to the wires or strips, is resolved into two waves of equal magnitude, polarized parallel and perpendicular, respectively, to the wires or strips. Most of the energy polarized parallel to these wires or strips is reflected back by them, and the energy polarized perpendicular to the wires or strips is transmitted to the back plate where it is reflected. The phase delay of the latter wave is arranged to be 180° relative to the former, so that, when it recombines with the waves reflected by the wires or strips, the resultant wave is polarized at a right angle to the incident wave.

One of the main drawbacks of the known reflecting plate type scanning antennas is that it is operable over a relatively narrow frequency band. Thus, the known constructions usually operate over a ten percent frequency band, this being mainly attributable to the construction and operation of the reflecting plate or twist reflector disposed behind the collimating paraboloid.

SUMMARY OF THE INVENTION

An object of the present invention is to provide a polarizer reflector, and also a reflecting plate type scanning antenna using such a polarizer reflector, operable over a substantially wider frequency band, in the order of one octave.

According to a broad aspect of the present invention, there is provided a polarizer reflector for reflecting an incident plane-polarized electromagnetic beam while rotating the plane of polarization through a predetermined angle, said polarizer reflector including a reflecting layer, and a polarizer on the side thereof facing the incident beam; said polarizer having means effective to convert the incident beam from linear polarization to circular polarization during the propagation of the beam forwardly through the polarizer to the reflecting layer, and to reconvert the beam reflected from said reflecting layer from circular polarization to linear polarization but rotated at said predetermined angle with respect to the polarization of the incident beam during the propagation of the beam from the reflecting layer back through the polarizer.

Particularly good results have been obtained when the mentioned polarizer is a meander-line polarizer, such as known for converting a wave from linear polarization to circular polarization as the wave propagates through the polarizer. In the present application, however, the meander-line polarizer effects two conversions, namely, one in the forward direction wherein it converts the incident beam from linear polarization to circular polarization, and the second in the return direction after reflection from the reflecting layer, wherein it reconverts the beam from circular polarization to linear polarization but rotated the predetermined angle with respect to the polarization of the incident beam. In the application of the present invention, the predetermined angle is a right angle.

This polarizer reflector has been found to be particularly applicable for use as the flat reflecting plate behind the collimating paraboloid in the abovementioned type of scanning antenna.

Therefore, according to another aspect of the present invention, there is provided a reflecting plate type scanning antenna comprising: feeder means for feeding thereto plane polarized electromagnetic radiation; a collimating paraboloid disposed in front of the feeder means for forming a collimated plane polarized beam; and a reflecting plate disposed behind the collimating paraboloid for producing a reflected resultant beam polarized at right angles to the polarization of the incident beam from the colimating paraboloid; characterized in that said reflecting plate includes a back-reflecting layer, and a meander-line polarizer on the face thereof facing said collimating paraboloid, which polarizer is effective to convert the incident beam, during its propagation forwardly through the polarizer from the collimating paraboloid to the back-reflecting layer, from linear polarization to circular polarization, and to reconvert the beam reflected from said back-reflecting layer from circular polarization to linear polarization, but at a right angle to the polarization of the incident beam, during the propagation of the beam from the back-reflecting layer.

It will thus be seen that the polarizer reflector, or reflecting plate in a scanning antenna constructed in accordance with the foregoing features, involves a different principle of operation than the reflecting plate in a conventional scanning antenna of this type. Thus, the reflecting plate in the conventional scanning antenna produces a reflected beam polarized at a right angle to the incident beam from the collimating paraboloid by producing two linear polarizations of the beam; however, in the scanning antenna of the present invention, the reflecting plate produces a linear-to-circular polarization in the forward direction through the polarizer to the back reflecting layer, and a circular-to-linear polarization in the return direction when reflected back from the back reflecting layer, the linear polarization of the resultant reflected beam being at a right angle to the linear polarization of the incident beam.

By using a reflecting plate involving the foregoing construction and operation, and particularly including a meander-line polarizer for effecting a linear-circular polarization in both directions, it is possible to produce a scanning antenna operable over a substantially wider frequency band, e.g., a 100% band, as compared to the narrow frequency band (e.g., 10%) characteristic of the conventional scanning antennas of this type.

Further features and advantages of the invention will be apparent from the description below.

BRIEF DESCRIPTION OF THE DRAWINGS

The invention is herein described, somewhat diagrammatically and by way of example only, with reference to the accompanying drawings, wherein:

FIG. 1 diagramatically illustrates one form of reflecting plate type scanning antenna constructed in accordance with the present invention;

FIG. 2 is a fragmentary plan view illustrating the construction of the front face of the reflecting plate included in the antenna of FIG. 1; and FIG. 3 is a sectional view along lines III—III of the reflecting plate of FIG. 2.

DESCRIPTION OF A PREFERRED EMBODIMENT

The scanning antenna illustrated in FIG. 1 comprises a feed horn, generally designated 2, for feeding plane polarized electromagnet waves. For example, feed horn 2 is supplied from a broad-band feed system which may be a monopulse system using broad band components.

Disposed in front of the feed horn 2, and illuminated thereby, is a front or transreflector in the form of a collimating paraboloid 6 for producing a collimated plane polarized beam. Paraboloid 6 may be of the parallel conductor type previously described above designated for efficient reflection of the wave polarized parallel to the conductors, and efficient transmission of the wave polarized perpendicular to the conductors.

The scanning antenna illustrated in FIG. 1 further includes a back reflector in the form of a reflecting plate, generally designated 10, disposed behind collimating paraboloid 6 for producing a reflected beam polarized at right angles to the polarization of the incident beam from the collimating paraboloid. However, the structure, and the mode of operation, of reflecting plate 10 included in the scanning antenna illustrated in FIG. 1 are different from the reflecting plate used in a conventional scanning antenna of this type.

The construction of the reflecting plate 10 is more particularly illustrated in FIGS. 2 and 3. Thus, it includes a stack of four insulating boards or sheets 12, 14, 16, and 18, each printed with electrically-conductive meander-lines **12*c*, and each separated from the adjacent one by foamed plastic spacer, e.g. 12*s* (FIG. 3). Reflecting plate 10 further includes a back-reflecting layer 20 next to the conductive meander-line 18*c* of the bottom printed circuit board 18**. The electrically-conductive meander-lines of each board are oriented at an angle of about 45° to the incident radiation, and are spaced from those of the next adjacent board about a quarter-wavelength apart.

As one example, the insulating boards 12, 14, 16, 18 may be made of copper-clad fiberglass photoetched to form the electrically-conductive meander-lines **12*c*, 14*c*, 16*c*, 18*c*; and the insulating spacers 12*s*, 14*s*, 16*s*** may be of polyurethane foam.

Reflector 10 may be constructed according to the known techniques for producing meander-line polarizers such as used with aperture-type antennas, except that in the present application it is also provided with the back-reflecting layer 20. Thus, the meander-line polarizer board 12, 14, 16, 18 effect two conversions of the incident beam, one conversion being from linear polarization to circular polarization during the propagation of the beam forwardly through the polarizer to the reflecting layer 20, and the other conversion being from circular polarization back to linear polarization, but rotated at a right angle to the polarization of the incident beam, during the propagation of the beam back from the reflecting layer 20 in the return direction through the polarizer.

The principle of operation under which such meander-line polarizers effect the conversion of linear to circular polarization (and vice versa in the present application) is well-known. Thus, the incident wave is resolved into two equal components which are in phase when incident on the polarizer, the polarizer producing a different phase shift of 90° between the two components as it passes through the polarizer, so that the wave exiting from the polarizer is circularly polarized. One component passes through a structure equivalent to a broad-band front-inductive filter, while the other passes through a broad-band front-capacitive filter, the two filters being designed to advance one component, and to retard the other component by about 45° at the same frequency near mid-band. The phase shift through either filter has almost the same slope, so that if the differential phase shift is 90° at one frequency in the common half-band, it remains close to 90° everywhere in th the common half-band. Further details of the construction and operation of such meander-line polarizers for converting a wave from linear polarization to circular polarization are described in the literature, for example *IEEE Transactions on Antennas and Propagation*, May 1973, pp. 376–378, which article is incorporated by reference as if fully set forth herein.

In the present application, as described earlier, the back-reflecting layer 20 is applied to the meander-line polarizer so as to produce two conversions, namely, from linear to circular in the forward direction to the reflecting layer, and from circular back to linear, but at a right angle to the polarization of the incident beam, in the return direction from the back-reflecting layer 20. Thus, the beam emerging from the polarizer reflector 10 is a plane polarized beam as is the incident beam, but is rotated 90° with respect to the incident beam.

As also indicated earlier, a primary advantage in using such a polarizer-reflector for the back reflector 10 in the described scanning antenna is that it imparts broad frequency band characterists to the antenna, permitting the antenna to operate over a wide frequency band in the order of about one octave as compared to the narrow frequency band (about 10% band width) of the previously-known constructions.

The polarizer reflector 10 is movably mounted, as in a conventional antenna of this type, and is driven by a drive schematically indicated by block 30 in FIG. 1, to effect scanning of the antenna, without the necessity of moving either the collimating paraboloid 6, or the feed horn 2 and its feed system 4.

While the invention has been described with respect to one preferred embodiment, it will be appreciated that many other variations, modifications, and applications of the invention may be made.

What is claimed is:

1. A wide band-width reflecting plate type antenna, comprising feeder means for feeding electromagnetic radiation; a front reflector disposed in front of the feeder means and illuminated by the electromagnetic radiation fed therefrom; and a back reflector disposed behind the front reflector for receiving the electromagnetic radiation reflected from the the front reflector and for producing a reflected beam which is polarized at a right angle to the incident electromagnetic radiation received from the front reflector; characterized in that said back reflector includes a reflecting layer, and a polarizer on the side thereof facing said front reflector, which polarizer includes means effective to convert substantially the entire energy of the incident electromagnetic radiation during its propagation forwardly through the polarizer to the reflecting layer, from linear polarization to circular polarization, and to reconvert substantially the entire energy of the electromagentic radiation reflected from said reflecting layer, during its propagation back through the polarizer, from circular polarization to linear polarization, but at a right angle to the incident electromagnetic radiation and whereby the phase delay between the polarizer and the reflecting layer does not affect the predetermined angle of rotation which is defined solely by the polarizer and wherein consequently the rotation through the predetermined angle takes place over a relatively wide band of frequencies.

2. The antenna according to claim 1, wherein said polarizer is a meander-line polarizer.

3. The antenna according to claim 1, wherein said front reflector is a collimating paraboloid for forming a collimated plane polarized beam, and wherein said back reflector is flat.

4. The antenna according to claim 1, wherein said back reflector is movably mounted to effect scanning of the antenna.

5. The antenna according to claim 1, wherein said feeder means comprises a broadband monopulse feeder system.

6. The antenna according to claim 2, wherein said meander-line polarizer includes a stack of at least four insulating boards each printed with electrically-conductive meander-lines, and insulation spacers spacing the electrically-conductive meander-lines from each other about one-fourth wave length apart, said meander-lines being oriented about 45° to the incident radiation.

7. The antenna according to claim 6, wherein said insulating spacers are layers of foamed plastic.

8. A wide band-width reflecting plate type scanning antenna comprising: feeder means for feeding thereto plane polarized electromagentic radiation; a collimating paraboloid disposed in front of the feeder means for forming a collimated plane polarized beam; and a reflecting plate disposed behind the collimating paraboloid for producing a reflected resultant beam polarized at right angles to the polarization of the incident beam from the collimating paraboloid; characterized in that said reflecting plate includes a back-reflecting layer, and a meander-line polarizer on the face thereof facing said collimating paraboloid, which polarizer is effective to convert substantially the entire energy of the incident beam, during its propagation forwardly through the polarizer from the collimating paraboloid to the back-reflecting layer, from linear polarization to circular polarization, and to reconvert substantially the entire energy of the beam reflected from said back-reflecting layer from circular polarization to linear polarization but at a right angle to the incident beam, during the propagation of the beam from the back-reflecting layer and whereby the phase delay between the polarizer and the reflecting layer does not affect the predetermined angle of rotation which is defined solely by the polarizer and wherein consequently the rotation through the predetermined angle takes place over a relatively wide band of frequencies.

9. The scanning antenna according to claim 8, wherein said meander-line polarizer includes a stack of at least four insulating boards printed with electrically-conductive meander-lines, each board being separated from the adjacent one by a foamed plastic spacer, spacing the meander-lines about one-fourth wave length apart, said meander-lines being oriented about 45° to the incident radiation.

* * * * *